US006428419B1

(12) United States Patent
Sheldon

(10) Patent No.: US 6,428,419 B1
(45) Date of Patent: Aug. 6, 2002

(54) AMUSEMENT ATTRACTION WITH MOVEABLE FLOOR

(75) Inventor: Benjamin L. Sheldon, Burbank, CA (US)

(73) Assignee: Universal City Studios, Inc., Universal City, CA (US)

( * ) Notice: Subject to any disclaimer, the term of this patent is extended or adjusted under 35 U.S.C. 154(b) by 0 days.

(21) Appl. No.: 09/547,170

(22) Filed: Apr. 11, 2000

(51) Int. Cl.[7] ..... A63G 31/60

(52) U.S. Cl. ..... 472/60; 472/61; 472/130; 434/55

(58) Field of Search ..... 472/59, 60, 61, 472/130, 75, 76; 434/29, 55, 34, 58; 52/6, 7, 8, 9

(56) References Cited

U.S. PATENT DOCUMENTS

| | | | | | |
|---|---|---|---|---|---|
| 3,399,887 | A | * | 9/1968 | Altier | 187/274 |
| 3,933,326 | A | * | 1/1976 | Schauffler | 244/118.5 |
| 4,875,660 | A | | 10/1989 | Gagnon et al. | 254/1 |
| 5,192,247 | A | | 3/1993 | Barr et al. | 472/60 |
| 5,277,662 | A | * | 1/1994 | Fox et al. | 104/35 |
| 5,365,704 | A | * | 11/1994 | Ray | 472/92 |
| 5,499,920 | A | | 3/1996 | Trumbull | 434/69 |
| 5,513,990 | A | * | 5/1996 | Gluck | 434/29 |
| 5,669,773 | A | | 9/1997 | Gluck | 434/62 |
| 5,678,889 | A | | 10/1997 | Purcell, Jr. | 297/257 |
| 5,711,670 | A | | 1/1998 | Barr | 434/55 |
| 5,719,763 | A | | 2/1998 | Leyden | |
| 5,829,201 | A | | 11/1998 | Schelter et al. | 52/9 |
| 5,845,434 | A | | 12/1998 | Hayashi | 52/9 |
| 5,857,917 | A | | 1/1999 | Francis et al. | 472/60 |
| 5,964,064 | A | * | 10/1999 | Goddard et al. | 352/43 |

* cited by examiner

*Primary Examiner*—Kien T. Nguyen
(74) *Attorney, Agent, or Firm*—Lyon & Lyon LLP

(57) ABSTRACT

An amusement ride or theater attraction has a moveable floor for guest loading and unloading. A screen displays images. A motion base moves guests in at least one degree of freedom. The moveable floor that has a cutout for the motion base. The moveable floor is positioned to a raised position during guest loading and unloading. The moveable floor is lowered to a lowered position during ride operation, with the motion base passing through the cutout. Loading and unloading of passengers is simplified, without limiting motion base movement during operation of the ride.

24 Claims, 8 Drawing Sheets

36
20
5
30
7
8
14
38
24
22
21
4

AMUSEMENT ATTRACTION WITH MOVEABLE FLOOR

BACKGROUND OF THE INVENTION

The field of the invention relates to amusement rides and attractions.

Various ride attractions have been developed that include a moving viewer platform that incorporates a motion picture or video display. These ride attractions have proven to be particularly popular with amusement park guests.

U.S. Pat. No. 5,711,670 discloses a motion base ride simulator having an improved guest loading and unloading apparatus. The ride incorporates a passenger cabin mounted to a motion base having multiple degrees of freedom. The cabin has tiered seating so guests have unobstructed views of the visual presentation. The ride has a three-dimensional operating envelope that defines the normal range of motion of the cabin during the ride.

Guests load/unload into and out of the ride via a stationary platform. The stationary platform is positioned just outside the operating envelope of the ride. During load/unload operations, the cabin is moved by the motion base to a location just outside of the normal operating envelope of the cabin. In this regard, the cabin is positioned adjacent to the stationary platform. A two-part cantilevered step is lowered into position to form a bridge-type structure between the stationary platform and the cabin. When the cantilevered step is lowered into position, the guests step into or out of the cabin.

In another example, U.S. Pat. No. 5,192,247 discloses a ride attraction or theater wherein a plurality of motion bases are positioned in a tier facing a projection screen. Images are projected onto the screen via a projector. Sound effects can also accompany the ride. Guests are seated on a viewer platform or vehicle. Guests are loaded into the platform or vehicle in a staging room area. An elevator is provided for lifting the vehicle containing guests above the staging room area. During the ride or theater presentation, actuators beneath each vehicle move the vehicle in multiple degrees of freedom.

Still other amusement rides utilize telescoping platforms or pivoting bridges that extend, in a telescoping-like or drawbridge-like movement, to moveable ride vehicles.

There are, however, some disadvantages to these types of loading/unloading methods and devices. In rides incorporating cantilevered bridges, such as in U.S. Pat. No. 5,711,670, complicated devices or control procedures are required. Another disadvantage with rides using draw bridge-type devices for passenger loading and unloading is that their use generally demands that the ride vehicle have an enclosed cabin. This results from having the draw bridge structure swing upward as is typically done. Without the enclosed cabins, the guests would are able to see the moving draw bridge structure, thus detracting from the overall ride experience. While draw bridge structures could be designed to swing downward, this would require the digging of one or more pits, which is costly and increases the design complexity of the ride facility.

Amusement rides such as in U.S. Pat. No. 5,192,247 patent often require tall buildings because of the lifts and tiered construction. Rides having moveable guest loading and unloading platforms are mechanically complex and expensive.

Accordingly, there is a need for an amusement ride or theater attraction that provides a simpler and less costly method and device for the loading and unloading of guests. Preferably, the device is capable of simultaneously loading a plurality of ride vehicles, each vehicle having multiple degrees of freedom via a motion base or the like. In addition, it is preferable that the device permit the tiered orientation of the plurality of ride vehicles.

SUMMARY OF THE INVENTION

In one aspect of the invention, an amusement ride has a projection screen for displaying images, and at least one motion base that supports a passenger platform. The ride advantageously uses a moveable floor that includes a cutout section for the motion base. The moveable floor is preferably positioned in a raised position for guest loading and unloading, and in a lowered position during operation of the ride.

In another aspect of the invention, the amusement ride includes a theater room containing a projection screen. A door connects an area outside of the theater room to an area inside the theater room. The amusement ride also has at least one motion base that supports a passenger platform. A moveable floor is included with the ride which further includes a cutout for each of the motion bases. The moveable floor is preferably in a raised position for guest loading and unloading and in a lowered position during operation of the ride. The ride also includes at least one floor movement device for raising and lowering the moveable floor.

It is an object of the invention to provide an improved amusement ride.

BRIEF DESCRIPTION OF THE DRAWINGS

In the drawings, wherein, the same reference number indicates the same element, throughout all of the Figures.

DETAILED DESCRIPTION OF THE PREFERRED EMBODIMENTS

Figure 1:
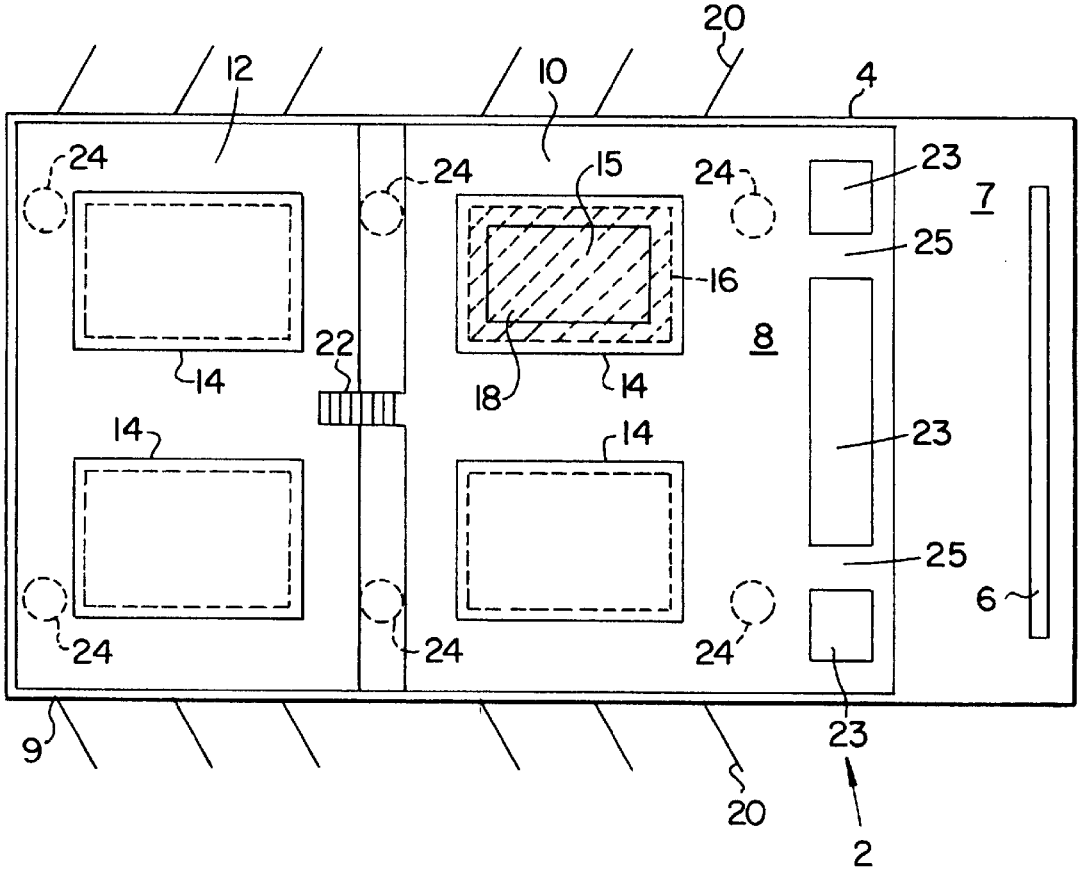
FIG. 1 is a plan view of a moveable floor.

Turning now to the drawings, as shown in FIG. 1 an amusement ride 2 or theater attraction includes a theater 4 that includes one or more screens 6. The screen 6 is used to display images such as a motion picture, video, or the like. The screen 6 can be illuminated from the front or rear. Alternatively, the projection screen 6 can be a video screen, display, or tube where images are generated. In addition, the theater may include a stage 7 in addition to, or in place of, the screen 6. Various imaging display media can be used in connection with the present device and method.

The amusement ride/theater 2 also includes a moveable floor 8 located within the theater 4. The moveable floor 8 is moveable between a raised position and a lowered position within the theater 4 depending on whether the amusement ride 2 is in operation or whether guest loading/unloading is occurring.

Figure 7:
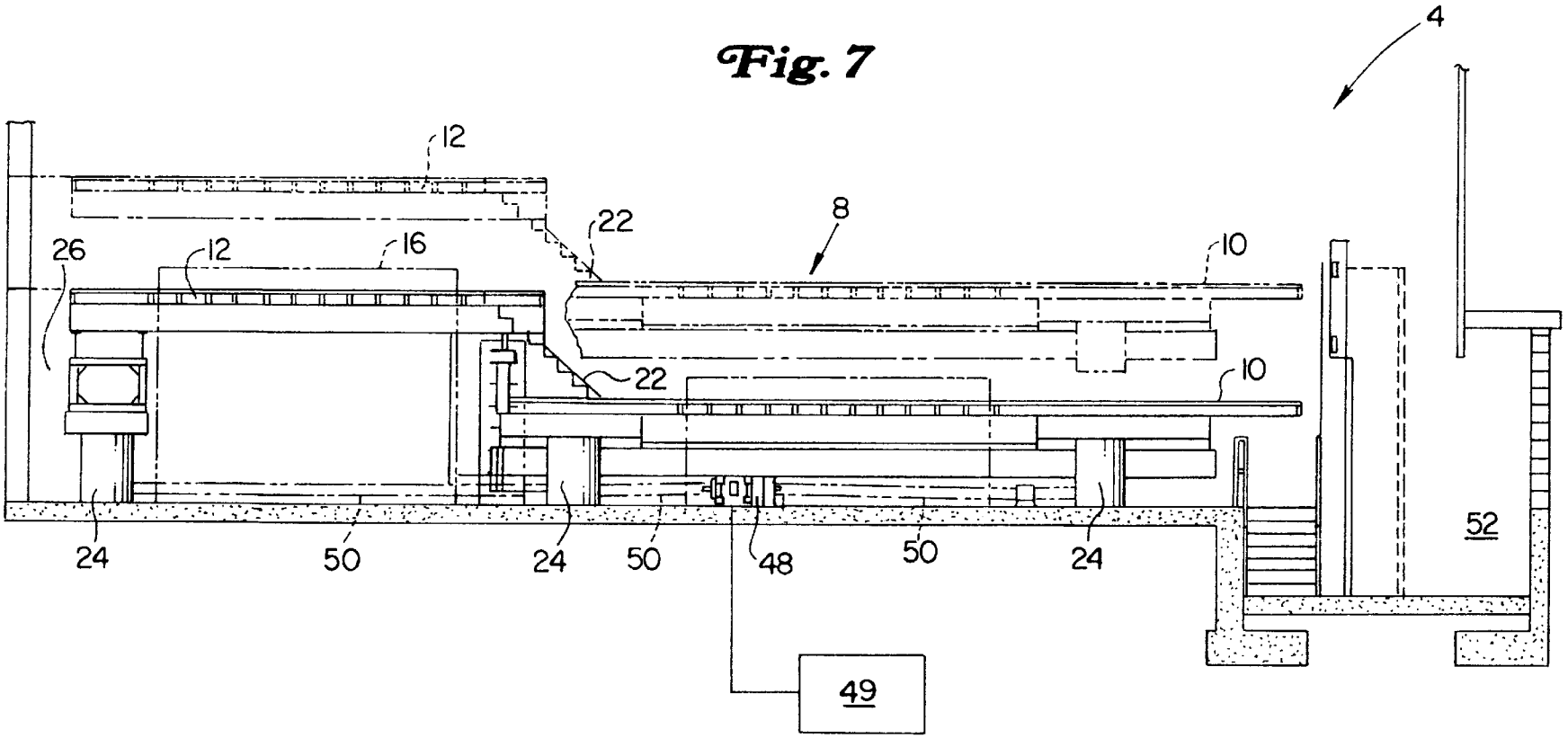
FIG. 7 is a view taken along the line 7—7 of FIG. 4.
Figure 8:
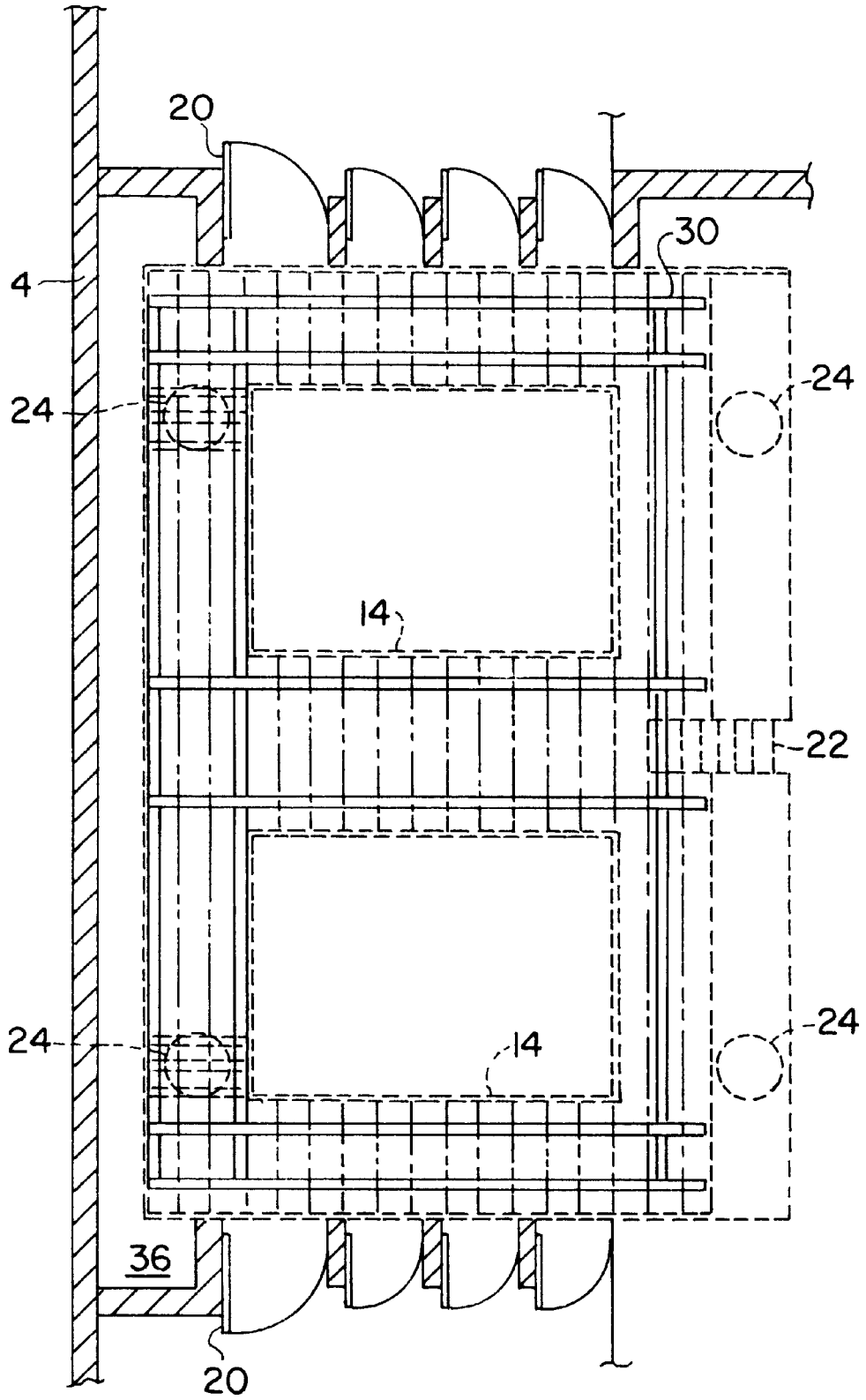
FIG. 8 is a plan view of the upper tier of the moveable floor.

Preferably, the moveable floor 8 has a plurality of tiered levels. FIGS. 1 and 7, illustrate a lower tier 10 and an upper tier 12, with the upper tier 12 located further from the projection screen 6 than the lower tier 10. In this manner, the moveable floor 8 permits stadium-type seating during the amusement ride/theater presentation 2 so each guest has an unobstructed view of the visual presentation of the projection screen 6 or on the stage 7. It should be understood, however, that the moveable floor 8 can be entirely level, i.e., without any tiered levels and still fall within the scope of the invention.

A plurality of cutouts 14, or open areas are provided within the surface of the moveable floor 8. The cutouts 14 act as openings within the moveable floor 8 for motion bases 16. Preferably, the cutouts 14 are smaller in size than the operational envelopes of the motion bases 16. The motion bases 16 are positioned within the cutouts 14 and impart motion to a passenger platform 18. The passenger platform 18 can be directly on the motion base 16, or alternatively, can be the floor of the ride vehicle 15. The passenger platform preferably has multiple passenger/audience member standing or seated positions. Motion bases 16 of the type disclosed in U.S. Pat. No. 5,192,247, incorporated by reference herein, can be employed. Preferably, the motion bases 16 have more than one degree of freedom. Even more preferably, there are six degrees of freedom to include: linear forward or aft motion, linear upward or downward motion, linear side-to-side motion, rotational pitch up or pitch down motion, rotational roll motion to either side, and rotational yaw motion.

The cutouts 14 may also be smaller in size than their corresponding motion base 16. In this manner, the motion base 16 is above the cutout 14 to a certain extent. One or more steps or the like affixed to the moveable floor 8 can be used to enter and exit the motion base 16.

In one aspect, the motion bases 16 include a passenger platform 18 where guests stand or sit down during the amusement ride or theater presentation 2. Optionally, a vehicle 15 can be positioned on each of the motion bases 16. If vehicles 15 are used, the passenger platform 18 is the floor or seat of the vehicle 15.

The moveable floor 8 may include an optional bench seating area 23. The bench seating area 23 is advantageously located on the portion of the moveable floor 8 that lies between the projection screen 6 and motion base 16 closest to the projection screen 6. The bench seating area 23 is provided for guests that are either unable or do not care to ride on the motion base 16. The optional bench seating area 23 preferably includes wheelchair accessible areas 25. Guests in wheelchairs that are unable or unwilling to leave their wheelchairs can enjoy the amusement ride attraction from a vantage point on the moveable floor 8. Guests that are seated in the bench seating area 23 and wheelchair accessible areas 25 are lowered together with the moveable floor 8 during ride operation. These guests, however, have an unobstructed view of the projection screen 6.

Figure 4:
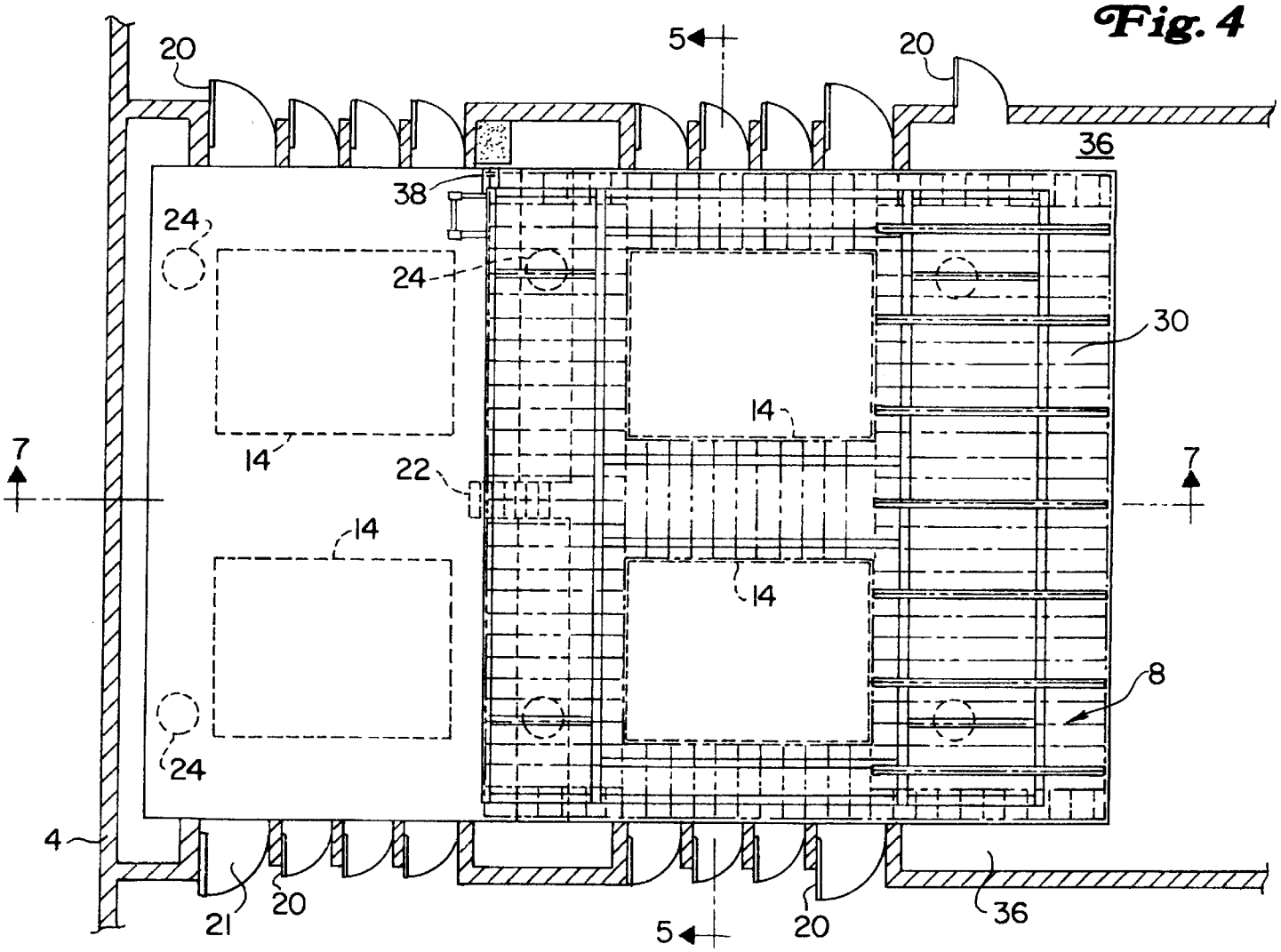
FIG. 4 is a plan view of the lower tier of the moveable floor.

Referring to FIGS. 1 and 4, the theater 4 includes a plurality of doors 20 on a loading/unloading level or floor 21. The doors 20 provide access to and from the theater 4. Preferably, a first set of doors 20 are located on one side of the theater 4 and a second set of doors 20 are located on an opposing side of the theater 4. For example, one set of doors 20 could be used to enter the theater 4 while another set of doors 20 is used for exiting the theater 4. While the location of the doors 20 is preferably on opposing sides of the theater 4, the doors 20 may be located in any location of the theater 4.

A small gap 9 is provided between the moveable floor 8 and the inner walls of the theater 4. The gap 9 is large enough to provide adequate clearance for the movable floor 8 during operation yet small enough to not interfere with guest movement between the moveable floor 8 and the theater 4. Preferably, the gap 9 is less than about 1 inch.

A staircase 22 is located between adjacent tiered levels. The staircase 22 provides access from one tiered level to an adjacent tiered level. FIG. 1 illustrates a staircase 22 between the lower tier 10 and the upper tier 12. While FIG. 1 illustrates the staircase 22 positioned in the center of the moveable floor 8, other locations and configurations could also be used.

Figure 2:
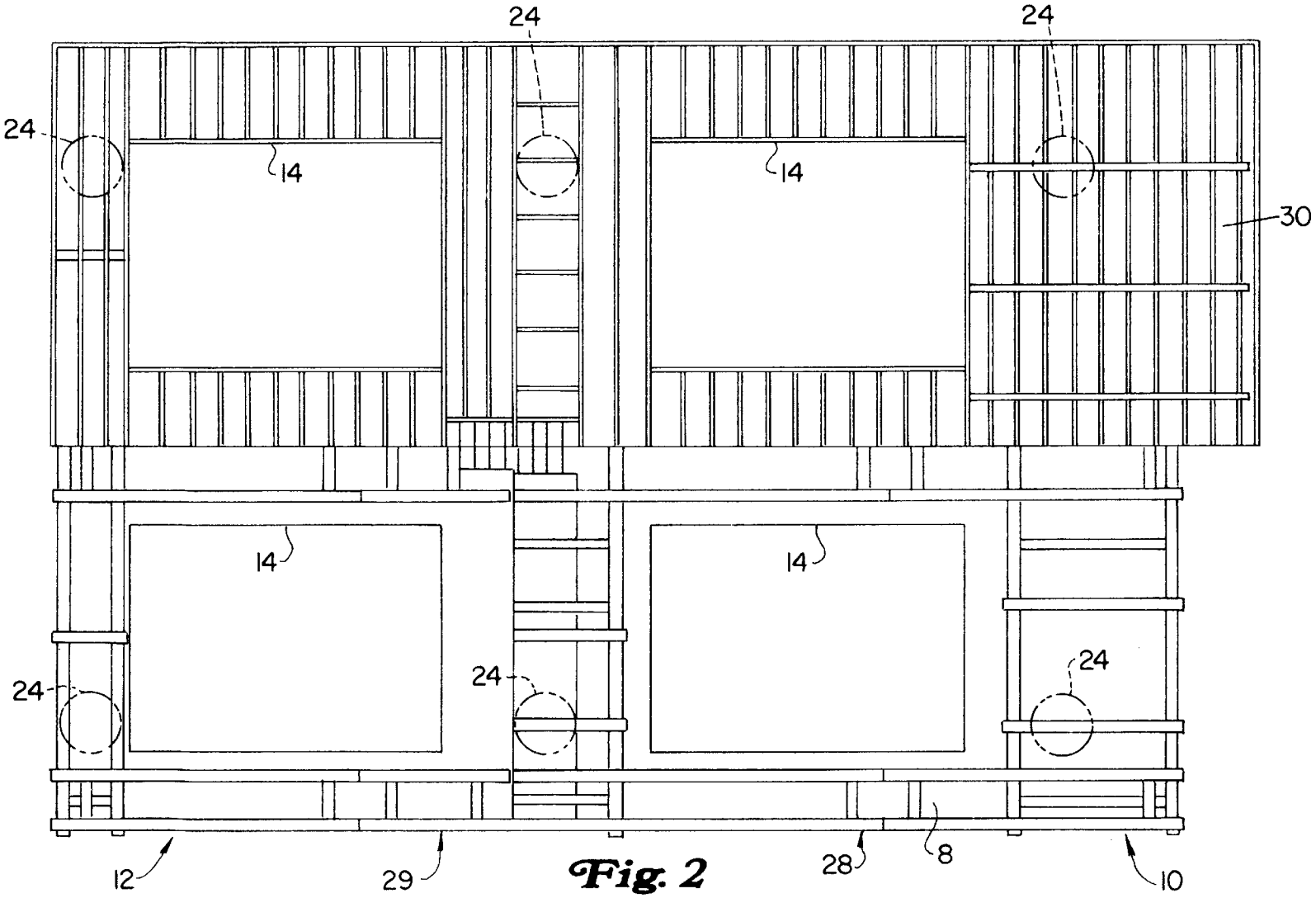
FIG. 2 is a plan view illustrating the structure of the moveable floor.

As shown in FIG. 2, a plurality of floor movement devices 24 are located underneath the moveable floor 8. The floor movement devices 24 are positioned within a storage area 26 of the theater 4. The storage area 26 can include a basement or the like. The floor movement devices 24 preferably connect the moveable floor 8 to the theater 4 foundation and adjust the vertical position of the moveable floor 8 between raised and lowered positions.

Referring still to FIG. 2, additional structure of the moveable floor 8 is shown. The moveable floor 8 includes an underlying superstructure 28, 29, which itself includes various subassemblies. Preferably, each tiered floor level has a separate superstructure. For example, lower tier 10 has a superstructure 28 separate from the superstructure 29 of the upper tier 12. A deck 30 covers the superstructure 28, 29. The deck 30 preferably is made of steel or other materials with sufficient structural strength.

Figure 3:
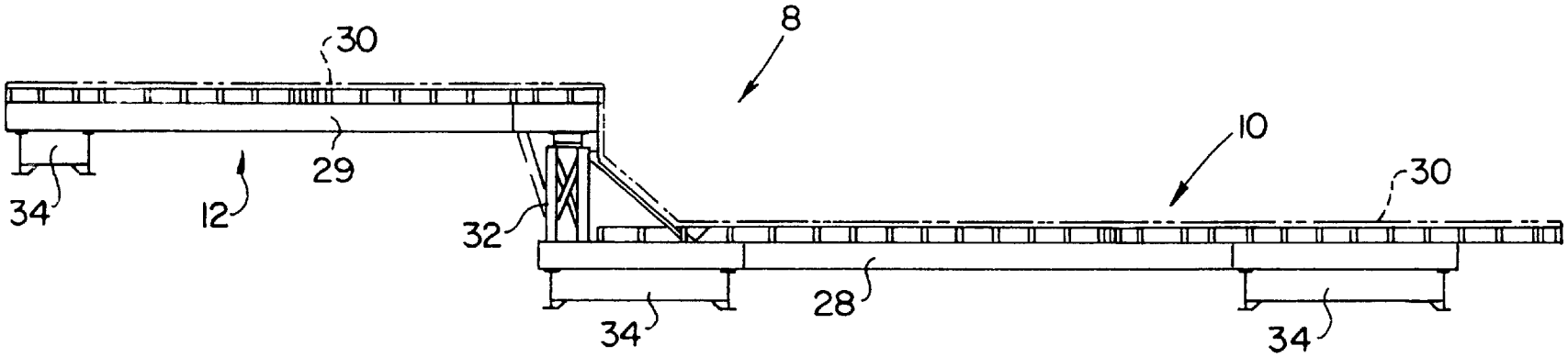
FIG. 3 is a side view illustrating the structure of the moveable floor.

FIG. 3 shows a side view of the moveable floor 8. As shown in this view, a connector subassembly 32 connects the lower superstructure 28 to the upper superstructure 29. Support beams 34 are positioned on the underside of the superstructure 28, 29 of the moveable floor 8.

Turning now to FIG. 4, as shown in this plan view of the moveable floor 8 within the theater 4, a border 36 surrounds at least a portion of the moveable floor 8. Preferably, the border 36 is a concrete deck.

Figure 5B:
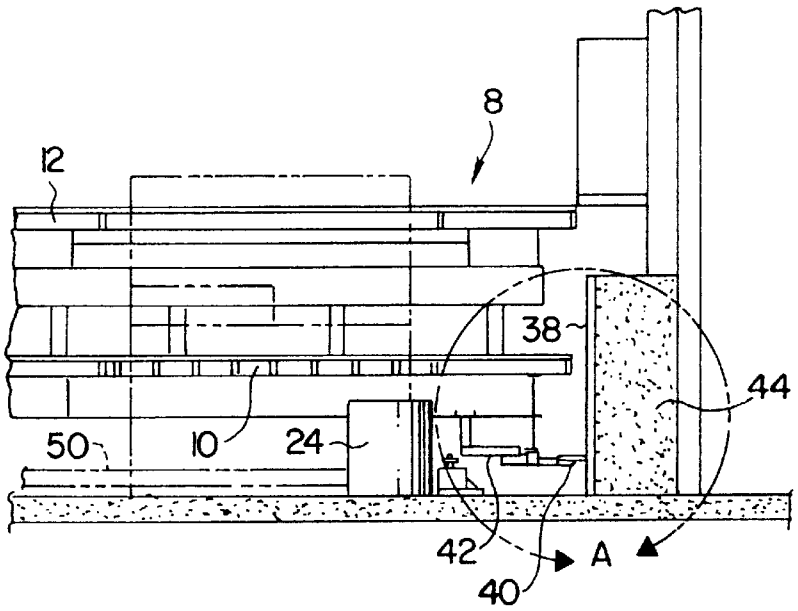
FIG. 5*b* is a section view thereof showing the floor in a down position.
Figure 5A:
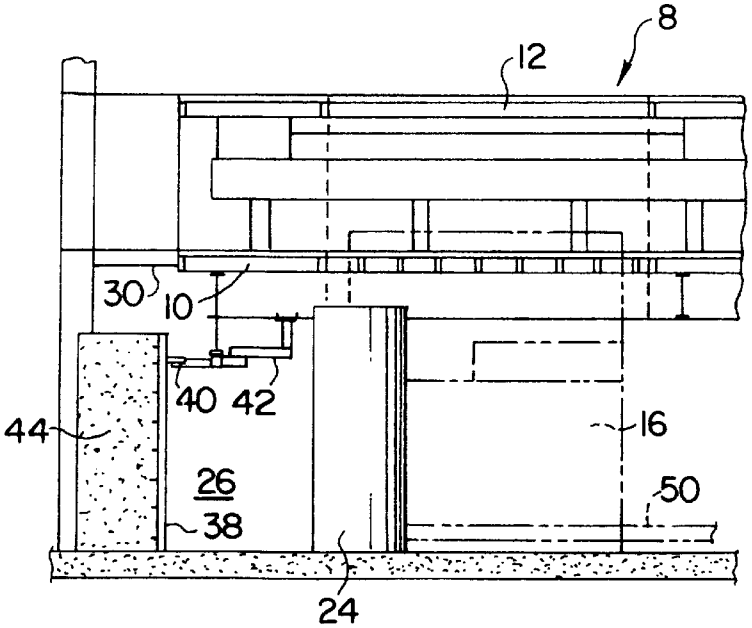
FIG. 5*a* is a section view taken along the line 5—5 of FIG. 4, and showing the floor in an up position.
Figure 6:
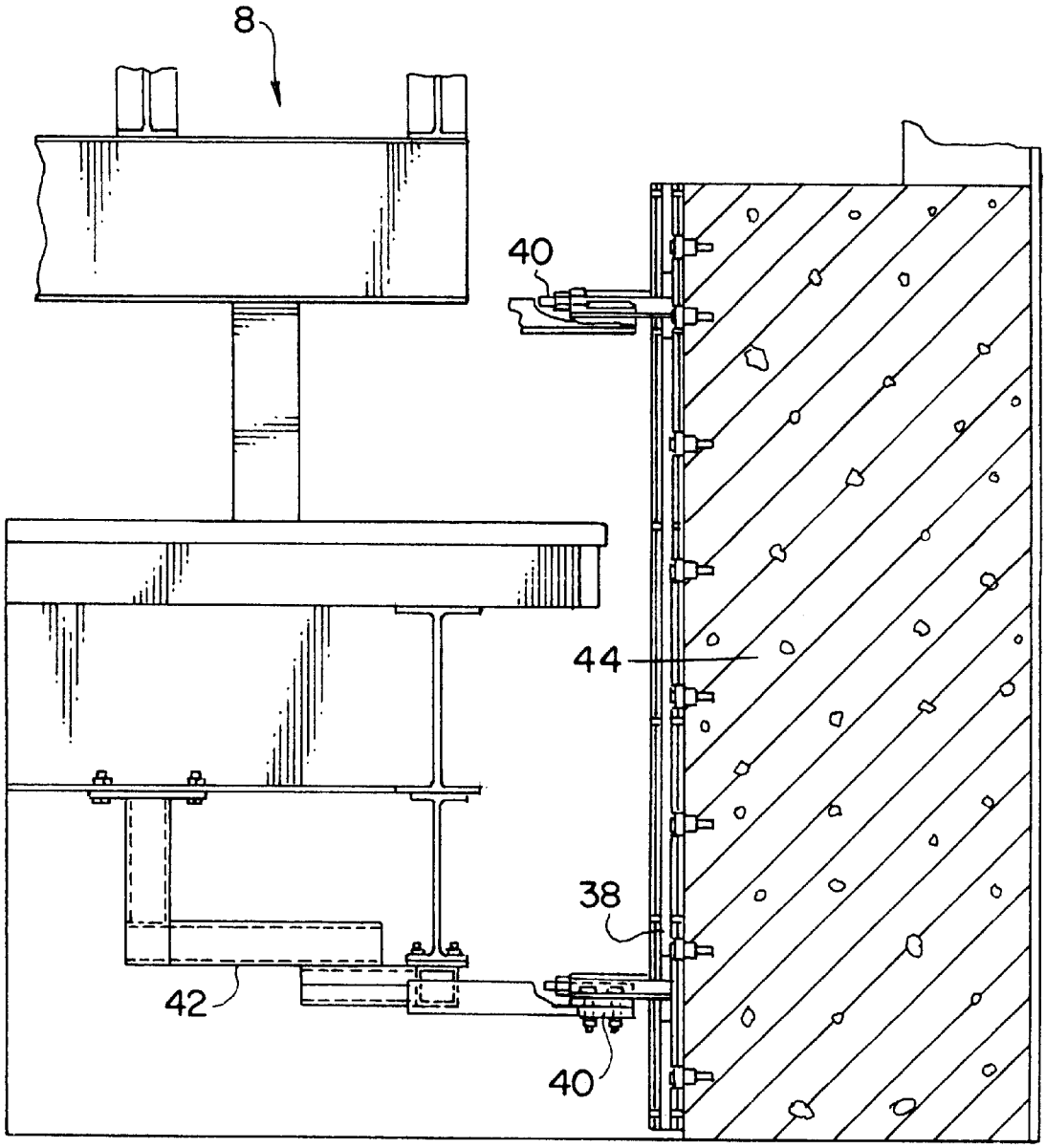
FIG. 6 is an enlarged view of region A shown in FIG. 5*b*.

As best shown in FIGS. 5A, 5B and 6, the moveable floor 8 preferably rides within a channel 38 that is secured within the structure of the theater 4, for example the storage area 26. A guide shoe 40 is attached to either side of the moveable floor 8 via guide arms 42 that travel vertically within a corresponding channel 38. The guide arms 42 attach to either the lower superstructure 28 or upper superstructure 29. Preferably, the guide arms 42 attach to either of the superstructure 28, 29 at a location substantially near the interface between the lower superstructure 28 and upper superstructure 29.

Referring to FIG. 6, each channel 38 is preferably attached to or formed in concrete pillars or posts 44 in the storage area 26 of the theater 4. The guide shoe 40 is held within the channel 38, thus restricting its motion, and thus the motion of the moveable floor 8, to only vertical movement. Preferably, the guide shoe 40 and attached movable floor 8 move a distance of about eight feet between the up and down positions.

During operation, the guide shoe 40 and guide arm 42 of both the right and left sides of the moveable floor 8 move up and down within their respective channels 38. FIG. 5A shown the guide shoes 40 and moveable floor 8 in the raised or up position. FIG. 5B shows the moveable floor 8 and guide shows 40 in the lowered or down position.

Referring now to FIGS. 4, 5A, 5B and 7, the floor movement devices 24 are preferably mounted in three regions of the moveable floor 8. A first set of floor movement devices 24 are preferably located under the lower tier 10. A second set of floor movement devices 24 are located under the upper tier 12. In addition, a third set of floor movement devices 24 are preferably located in the center region of the moveable floor 8. The lower ends of the floor movement devices 24 are attached to the floor or foundation of the theater 4. The upper ends of the floor movement devices 24 are attached to the moveable floor 8. Preferably, the floor movement devices 24 are mounted in the storage area 26 region of the theater 4 and are out-of-sight from the guests.

The floor movement devices 24 can be any number of devices commonly used as lifts or jacks. For example, airbags, pneumatically operated lifts, hydraulic lifts, electrically powered lifts, jack screw-type devices, and pulley-type systems can be used. Most preferably, the lifts 24 are push actuators of the type disclosed in U.S. Pat. No. 4,875,660 incorporated herein by reference.

Referring to FIG. 7, the floor movement devices 24 receive power from one or more motors 48 located in the storage area 26 region. A plurality of drive shafts 50 mechanically couple each motor 48 to the floor movement devices 24. The motors 48 are preferably controlled via a controller or computer 49 during operation. The theater 4 may also include a separate machine room 52 that provides access to working components of the amusement ride located in the storage area 26. In this manner, there is easy access to the working components of the amusement ride 2 for repair and maintenance.

The amusement ride/theater attraction 2 operates as follows: The guests, prior to entry into the theater 4, preferably have viewed a pre-show attraction that prepares the guests for the main attraction in the theater 4. Of course, the pre-show attraction is optional and not necessary to the practice of the invention disclosed herein.

After the pre-show, if any, guests enter the theater 4 via the doors 20. At this point, the moveable floor 8 is in the raised or up position, with the deck 30 of the moveable floor 8 substantially flush with the floor 21 of the corresponding doorways. Substantially flush means that two adjacent surfaces are within a distance of approximately a standard stair step (4–12 inches, and preferably 6–8 inches) of each other. If the moveable floor 8 has multiple tiers, each tier is preferably placed adjacent to corresponding doors 20. For example, the doors 20 and loading/unloading floor 21 leading to the upper tier 12 are located higher than the doors 20 and loading/unloading floor 21 leading to the lower tier 10. Guests walk from the fixed floor loading/unloading floor 21, through the doors 20, and then travel across the deck 30 to the passenger platform 18 of the motion bases 16. Preferably, the passenger platform 18 of the motion base 16 or vehicle 15 attached to it is substantially flush with the deck 30 of the moveable floor 8. Substantially flush means that two adjacent surfaces are within a distance of approximately a standard stair step (4–12 inches, and preferably 6–8 inches) of each other.

Once guests have entered onto the motion bases 16 or ride vehicles 15, the guests are seated and secured through conventional devices such as belts, restraining bars, straps, and the like. Alternatively, the guests may be secured in a standing position. After all of the guests have been seated and secured, the guests' attention is directed to the side of the theater 4 containing the projection screen 6 or stage 7. The guests' attention can be directed to the projection screen 6 through the use of audio and visual effects, or via live actors. The visual effects can include fog, mist, images projected onto the screen, lasers, and the like.

While the guests' attention is diverted toward the projection screen 6 or stage 7, the moveable floor 8 is lowered from its initial raised or up position to a lowered or down position. The lowering of the moveable floor 8 is done smoothly quietly so that the guests do not realize that the moveable floor 8 is lowered. Audio and visual effects are preferably used as the moveable floor is lowered. The lowered position of the movable floor 8 creates an adequate amount of clearance between the motion base 16 and the moveable floor 8 such that the motion base 16 can move within their full operational envelope without contacting the moveable floor 8 during ride operation. During the ride or presentation, when the moveable floor 8 is in the lowered position, images are projected onto the projection screen 6. Audio effects can also accompany the projected images. Preferably, the images and the audio effects are synchronized with the motion of the motion bases 16, as is well known in the field. See, for example, U.S. Pat. Nos. 5,192,247 and 5,719,763, incorporated herein by reference.

After completion of the ride or presentation, the motion bases 16 are returned to their previous loading locations and the moveable floor 8 is raised into the raised position. The guests can then depart the motion bases 16 or vehicles 15 and exit the theater 4 via doors 20. The doors 20 can either be the same doors 20 the guests used when entering the theater 4, or alternatively, the doors 20 are located on an opposite side of the theater 4. The guests may also exit doors 20 on a different tier by using the staircase 22 between tiers.

The doors 20, gap 9, and seating or standing positions on the motion bases 16 are preferably dimensioned and configured to accommodate wheelchairs and physically disabled guests.

While embodiments of the present invention have been shown and described, various modifications may be made without departing from the scope of the present invention. The invention, therefore, should not be limited, except to the following claims, and their equivalents.

What is claimed is:

1. An amusement attraction comprising:

a screen for displaying images;

at least one motion base supporting a passenger platform; and a moveable floor including a cutout aligned with the motion base, so that the moveable floor can move from an up position for guest loading and unloading, to a down position, during operation of the ride.

2. An amusement ride according to claim 1, the motion base further comprising a ride vehicle mounted on the motion base.

3. An amusement ride according to claim 1, wherein said moveable floor includes a plurality of tiered levels.

4. An amusement ride according to claim 3, further including at least one set of stairs leading from a lower tier level to a higher tier level on the moveable floor.

5. An amusement ride according to claim 1, further including a theater building containing the screen, motion base, and moveable floor, and an area for storing said moveable floor when said floor is in the lowered position.

6. An amusement ride according to claim 5 further including a plurality of channels in the area for storing the moveable floor, with the channels engaging with guide shoes attached to the moveable floor.

7. An amusement ride according to claim 1 further including at least one floor movement device for moving the moveable floor between the up and down positions.

8. An amusement ride according to claim 7 further including at least one motor for driving the at least one floor movement device.

9. An amusement ride according to claim 7, wherein the at least one floor movement device comprises a push actuator.

10. An amusement ride according to claim 1, further including a plurality of doors leading to the moveable floor, the doors located adjacent to the floor when said moveable floor is in the raised position.

11. An amusement ride according to claim 1, wherein the motion base moves with at least one degree of freedom.

12. An amusement ride according to claim 1, wherein the motion base moves within an operational envelope, and the cutout is smaller than the operational envelope of the motion base.

13. An amusement ride according to claim 1, wherein the passenger platform comprises a ride vehicle.

14. An amusement ride according to claim 1, wherein the passenger platform is substantially flush with the moveable floor when said moveable floor is in the up position.

15. An amusement ride according to claim 1 further including a stationary deck surrounding at least a portion of said moveable floor.

16. An amusement ride according to claim 1 further including a live actor stage between the screen and the motion base.

17. An amusement attraction comprising:

a theater room containing a projection screen;

a door connecting an area outside the theater room to an inside area of the theater room;

at least one motion base supporting a passenger platform;

a moveable floor including a cutout for at least one motion base, wherein said moveable floor is in an up position for guest loading and unloading and in a down position during operation of the attraction; and at least one floor movement device for raising and lowering said moveable floor.

18. An amusement attraction according to claim 17, with at least one motion base including a ride vehicle mounted thereon.

19. An amusement attraction according to claim 17, wherein said moveable floor includes a plurality of tiered levels.

20. A method of loading and unloading guests onto a passenger platform of a motion base located within a theater, comprising the steps of:

moving a moveable floor located within the theater to a raised position during the loading or unloading of guests; and moving the moveable floor to a lowered position within the theater during ride operation.

21. The method of claim 20 further comprising the step of passing the motion base through a cutout in the moveable floor that is vertically aligned over the motion base during the step of moving the moveable floor to a lowered position.

22. An amusement attraction comprising:

an image display device;

at least one motion base supporting a passenger platform; and a moveable floor including a cutout aligned with the motion base, so that the moveable floor can move from an up position for guest loading and unloading, to a down position, during operation of the ride.

23. An amusement ride according to claim 22, further including a theater containing the image display device, motion base, and moveable floor.

24. An amusement ride according to claim 23, further including a door connecting an area outside the theater room to an inside area of the theater room.

* * * * *